US007897949B2

(12) United States Patent
Ballsieper

(10) Patent No.: US 7,897,949 B2
(45) Date of Patent: Mar. 1, 2011

(54) LAMINATED LEAD-FREE X-RAY PROTECTION MATERIAL

(75) Inventor: Barbara Ballsieper, Taufkirchen (DE)

(73) Assignee: Mavig GmbH, München (DE)

( * ) Notice: Subject to any disclaimer, the term of this patent is extended or adjusted under 35 U.S.C. 154(b) by 233 days.

(21) Appl. No.: 12/306,116

(22) PCT Filed: Jun. 25, 2007

(86) PCT No.: PCT/EP2007/005610

§ 371 (c)(1),
(2), (4) Date: Jan. 15, 2009

(87) PCT Pub. No.: WO2007/147642

PCT Pub. Date: Dec. 27, 2007

(65) Prior Publication Data

US 2009/0272921 A1 Nov. 5, 2009

(30) Foreign Application Priority Data

Jun. 23, 2006 (DE) ..... 10 2006 028 958

(51) Int. Cl.
*G21F 1/12* (2006.01)

(52) U.S. Cl. ..... 250/515.1; 250/505.1; 250/516.1; 250/518.1; 250/519.1

(58) Field of Classification Search ..... 250/505.1, 250/515.1, 516.1, 518.1, 519.1
See application file for complete search history.

(56) References Cited

U.S. PATENT DOCUMENTS

| | | | | |
|---|---|---|---|---|
| 5,115,140 | A | 5/1992 | Rodriguez | |
| 5,190,990 | A | 3/1993 | Eichmiller | |
| 6,153,666 | A * | 11/2000 | Lagace | 523/136 |
| 6,448,571 | B1 * | 9/2002 | Goldstein | 250/515.1 |
| 6,674,087 | B2 * | 1/2004 | Cadwalader et al. | 250/515.1 |
| 7,041,995 | B2 * | 5/2006 | Eder | 250/515.1 |
| 7,294,845 | B2 * | 11/2007 | Ballsieper | 250/516.1 |
| 7,432,519 | B2 * | 10/2008 | Ballsieper | 250/516.1 |

FOREIGN PATENT DOCUMENTS

| | | |
|---|---|---|
| DE | 102 34 159 C1 | 11/2003 |
| EP | 0 127 241 A1 | 12/1984 |
| JP | 2001-074882 A | 3/2001 |
| WO | WO 2005/024846 A1 | 3/2005 |

* cited by examiner

*Primary Examiner*—David A Vanore
(74) *Attorney, Agent, or Firm*—Scully, Scott, Murphy & Presser, P.C.

(57) ABSTRACT

Laminated lead-free radiation protection material (10, 12, 14) comprising at least two individual composite layers (2),
each individual composite layer (2) comprising a secondary radiation layer (4) with a low Z material and a barrier layer (4) with a high Z material,
wherein the individual composite layers (2) are arranged in the radiation protection material (10, 12, 14) in such a way that a barrier layer (8) is arranged on both surfaces (18, 20) of the radiation protection material (10, 12, 14), and the respective secondary radiation layer (8) is arranged at a distance from the surface (18, 20).

31 Claims, 4 Drawing Sheets

LAMINATED LEAD-FREE X-RAY PROTECTION MATERIAL

The present invention relates to a laminated X-ray or radiation protection material and in particular to a radiation protection material provided with a secondary radiation layer with a low Z radiation protection material and a barrier layer with a high Z radiation protection material.

Radiation protection materials provided with a secondary radiation layer with a low Z radiation protection material and a barrier layer with a high Z radiation protection material are known from WO 20051024846 A1, WO 2005/023116 A1 and DE 1 010 666 A1 but are not yet used in practical applications.

Radiation protection materials are used in medical technology to protect the attending physicians, but also to protect those parts of the patient's body which should not be subjected to radiation. A typical example of such an application are protective aprons which are predominantly worn by the physicians and medical personnel, as well as partial body protection gear such as a for example gloves, head gear, thyroid gland protection, gonad protection, ovary protection. The latter three in particular are intended to protect those parts of the body of the patient to be X-rayed which should not be exposed to radiation. In addition, there are stationary protection devices located in the immediate vicinity of the patient or the medical professional, such as radiation protection curtains and shields on X-ray machines.

Conventional radiation protection clothing in the medical field usually contains lead or lead oxide as protective material. The use of lead is disadvantageous due to the environmental pollution resulting from its toxicity and due to its relatively high weight. Therefore, more and more efforts have been made recently to provide lead-free radiation protection material and thus lead-free radiation protection clothing. Such radiation protection materials should have sufficient absorption properties in the energy range of an X-ray tube having a voltage of from 60 to 125 kV. The absorption properties of the radiation protection material are expressed by an attenuation value, or attenuation factor, e.g. in the form of the lead attenuation value (in short: lead equivalent) (International Standard IEC 61331-1, protective devices against diagnostic medical X-radiation). Some of the elements used in the lead-free radiation protection materials exhibit a dependence of the absorption on the radiation energy which significantly differs from that of lead. In addition, while some of the elements used for absorption purposes show sufficient absorption in the relevant energy range, a part of the absorbed energy is re-emitted from the lead-free radiation protection material in the form of X-ray fluorescence radiation in a spatially distributed manner. Together, the X-ray fluorescence radiation, the classic scattered radiation, and the Compton scattering are referred to as secondary radiation. The X-ray fluorescence radiation accounts for a significant portion of the secondary radiation. In order to shield from secondary radiation, combinations of different elements are frequently used to mimic the absorption behavior of lead. As has been shown, the lead-free radiation protection materials which are currently commercially available show hardly any advantage compared to lead in terms of weight. A lower weight in combination with the same attenuation effect is only achieved with a structure comprising a secondary radiation layer and a barrier layer wherein the secondary radiation, which mainly consists of X-ray fluorescence radiation (characteristic X-ray radiation), is effectively shielded by the barrier layer so that it cannot escape from the radiation protection material. Only under this condition is it possible to gain a weight advantage of maximum about 20% compared to lead.

In particular, the barrier layer serves to absorb the secondary radiation, especially the high content of X-ray fluorescence radiation, which is generated in the secondary radiation layer during the absorption of low-energy X-ray radiation. Since secondary radiation or fluorescence radiation is essentially radiated evenly in all directions by the secondary radiation layer, the barrier layer in radiation protection clothing is provided close to the body while the secondary radiation layer is provided away from the body.

Depending on the type of application, X-ray or radiation protection clothing is generally offered at different protection levels, e.g. 0.25 mm, 0.35 mm, 0.50, 1.0 mm nominal Pb value, whereby it has been suggested to create a radiation protection material with all of these different protection levels by combining individual layers in order to facilitate the production process.

A problem that has been largely ignored so far is the fact that in a radiation protection material with a barrier layer close to the body and a secondary radiation layer away from the body only the secondary radiation aimed at the body of the medical professional is absorbed by the barrier layer. This is sufficient for common X-ray examinations since in those cases the patient is usually alone during imaging. However, it is more problematic for example during surgery if the patient is regularly or continuously X-rayed while the surgeon and/or additional medical personnel remain in close proximity to the patient. The medical staff is protected relatively well by the X-ray protection aprons they all wear. However, the situation is different for the patient who, in addition to the normal X-ray radiation, is also exposed to the added dose of secondary radiation emitting from the radiation protection clothing of the medical staff. So far, this problem has been paid little or no attention.

It is therefore the object of the present invention to provide a radiation protection material with protection at different levels, e.g. 0.25 mm, 0.35 mm, 0.50, 1.0 mm nominal Pb value, which can be manufactured relatively easily and which absorbs the secondary radiation emitting to both sides—both to the medical professional and the patient—to a large degree.

According to the present invention, this object is achieved by a multi-layer, lead-free radiation protection material comprising at least two individual composite layers, wherein each individual composite layer comprises a secondary radiation layer with a low Z radiation protection material and a barrier layer with a high Z radiation protection material and wherein the individual composite layers are arranged such in the radiation protection material that a barrier layer is provided on each surface of the radiation protection material and the respective secondary radiation layer is provided away form the surface. In other words, the secondary radiation layers are located inside of the radiation protection material while the barrier layers are provided on the surfaces, or face the surfaces.

In such a material, the X-ray radiation entering the protective material is absorbed particularly effectively by the secondary radiation layer provided inside the lead-free radiation protection material. However, the secondary radiation forming during this absorption cannot escape from the radiation protection material since a barrier layer is provided on each of the two surfaces. The structure according to the present invention comprising at least two individual composite layers offers some considerable advantages in manufacturing. In particular, one single such individual composite layer material can be used to produce a radiation protection material with the desired protection values since two such layers result in a radiation protection material with 0.25 mm nominal Pb value, three such individual composite layers result in a radiation protection material with 0.35 mm nominal Pb value and four individual composite layers result in a radiation protection material with 0.50 mm nominal Pb value. The individual composite layers can be processed to form the radiation protection material with the desired protection value immediately during manufacture, for example by folding and/or gluing. Alternatively, the sequence of individual composite layers can be produced during the manufacture of the radiation protection clothing. The sequence of layers can be connected by gluing. It is also possible to sew the individual layers together. Another way to connect the layers is to provide them in a joint shell. It is for example possible to provide a "bag" made from a suitable material, for example a textile material or PVC, and to "lower" the layers into this bag. The individual layers then hang in the bag like a curtain. Such an arrangement has the advantage that the layers do not have to be glued together but rather hang together loosely, which leads to a markedly lower stiffness than if the layers were glued together. The bag and/or the individual layers can be sewn together, for example they can be sewn along their edges. It is also possible to seal the individual layers. Here as well, they can be sealed along their edges. Instead of a bag which is essentially completely closed except for one opening, an inner and an outer cover layer can be provided which are connected with the individual intermediate layers, for example by sewing or sealing. Other bonding methods can be applied as well.

One disadvantage of the radiation protection material structure in the form of loosely stacked individual layers is their proneness to mechanical damage. For instance, it has been found that in the case of aprons, the radiation protection material is worn down at folds or typical points of contact, where the user rubs for example against edges of a table. This is particularly true for the structure consisting of several individual layers, but also for radiation protection materials which are produced from one single thick layer. It is therefore preferred to provide a sliding layer on at least one side of a radiation protection material layer. The sliding layer can be provided as a separate layer. The sliding layer can also be formed integrally with the radiation protection material layer. For instance, in that case, a thin Teflon coating can be provided on the radiation protection material layer. In the case of several individual layers, it is particularly advantageous to provide slide-promoting intermediate layers between the individual layers. These intermediate layers made from the above-mentioned Teflon can either be provided separately or, as described above, in the form of an additional layer on the lead-free material. On the other hand, a fibrous material, for example glass silk, which is available in wafer-thin layers, can be used as a slide-promoting intermediate layer. In particular in the case of the above-described production in a "bag", it is relatively simple to incorporate such intermediate layers. It is also possible to provide a double intermediate layer in which case an intermediate layer rubs against an intermediate layer between two individual layers which translates into a particularly low coefficient of friction. It is furthermore possible to produce the "bag" from a slide-promoting material or to provide a sliding layer on its interior. It is pointed out that this feature of a sliding layer in itself is considered inventive, in particular without all or only some of the features of claim 1.

As regards the provision of a sliding layer or several sliding layers in the radiation protection material, additional explanations will be given in the paragraphs below:

In the radiation protection material it is advantageous to provide sliding layers in those areas where there are no adjacent components connected via their surfaces in order to reduce friction, counteract wear and damage, and avoid a decrease in flexibility due to friction. This applies to adjacent radiation protection components (in particular in the case of secondary radiation layer against secondary radiation layer, or barrier layer against barrier layer, or secondary radiation layer against barrier layer, whereby the mentioned layers are part of an individual composite layer or not part of an individual composite layer) but also to a radiation protection component (in particular in the case of a secondary radiation layer or a barrier layer, each of which is part of an individual composite layer or not part of an individual composite layer) adjacent to a cover layer (which, in turn, has a single-layer or a multi-layer structure) of the radiation protection material, Sliding layers can be provided in all of the structures discussed above, alternatively only in what is considered an important portion of such adjacent components or, at the very least, only in one such situation of adjacent components.

Each of the sliding layers can be its own layer, e.g. polytetrafluoroethylene film or a—preferably light and pliant—fabric of polyamide or polyester or other plastic fibers or glass fibers. The sliding layer can be a punched part, punched in the desired outline. The following methods are preferred for connecting the sliding layer to the radiation protection materials Connection only at the upper edge of the sliding layer and/or at the two side edges or additionally also at the lower edge. Sewing and gluing are the preferred connection methods.

Alternatively, the sliding layer can be connected with a radiation protection component via a large surface area or the entire surface area, preferably by laminating or in the form of a fabric connected to a radiation protection material layer. A polytetrafluoroethylene film and a—preferably light and pliant—fabric of polyamide or polyester or other plastic fibers or glass fibers are preferred.

The methods described above do not have to be applied in the same manner in all the sliding layers of the radiation protection material. Variations are possible for every sliding layer within the radiation protection material.

If it is connected to the radiation protection layer via a large surface area or the entire surface area, the sliding layer can also serve as a reinforcing layer or carrier layer, or constitute the only reinforcing layer or carrier layer of this radiation protection material layer.

It is possible to provide an adhesive layer between the sliding layer and the other radiation protection material layer in order to perfect the bonding.

It is explicitly emphasized that the radiation protection material with at least one sliding layer as described above constitutes its own invention and is realized in an advantageous manner even without the features of claim 1 and even in the case of lead-containing radiation protection materials and/or in the case of radiation protection materials which do not have a structure comprising secondary radiation layer(s) and barrier layer(s). On the other hand, all the features disclosed in this application can be realized alone or in combination as preferred features together with the sliding layer.

Preferably, an individual composite layer has a protection value of about 0.25 mm, 0.20 mm, 0.175 mm or about 0.125 mm nominal Pb value. For instance, an individual composite layer which can be used to build the common protection values can have a protection value of between 0.05 mm to 0.15 mm nominal Pb value. The smaller the protection value, the thinner and the more easily the individual composite layers can be produced, and the lighter and more elastic the resulting piece of radiation protection clothing will be since the individual layers each have a low degree of stiffness. In the radiation protection material, the individual composite layers can be essentially identical. A single type of individual composite layer is enough to produce the desired radiation protection material. A protective apron with 0.5 mm nominal Pb can be constructed from 5 identical individual composite layers with a nominal value of 0.100 mm each in order to achieve a high level of comfort for the wearer (flexibility). Also, individual composite layers with different nominal Pb values, e.g. 0.125 and 0.100 mm, can be combined to arrive at a certain total nominal value of the protective clothing. For example, a protection layer with a protection value of 0.25 mm nominal Pb value can be produced from two individual layers with about 0.125 mm nominal Pb value. However, one could also conceive of e.g. three individual composite layers with a protection value of slightly less than 0.1 mm nominal Pb value. It is also possible to combine two individual composite layers with a protection value of about 0.1 mm nominal Pb value with another layer with 0.05 mm nominal Pb value. Accordingly, a radiation protection material with a protection value of about 0.35 mm nominal Pb value could for example be produced from two individual composite layers with 0.175 mm nominal Pb value each or from three individual composite layers with 0.125 mm nominal Pb value each, Accordingly, a radiation protection material with a protection value of about 0.5 mm nominal Pb value could for example be produced from four individual composite layers with 0.125 mm nominal Pb value each or from two individual composite layers with 0.25 mm nominal Pb value each. Other combinations, such as for example one 0.25 nominal Pb value and two 0.125 mm nominal Pb value are possible as well. It is also conceivable to only provide individual composite layers with barrier layer and secondary radiation layer on the outside of the radiation protection material and to arrange one or more individual layers between those two layers, e.g. those of low Z material or layers mainly comprising low Z materials, with or without barrier layer.

A cover layer, e.g. a textile cover or PVC, is incorporated for example into radiation protection clothing at the outer surface and/or the inner surface of the radiation protection material. The cover layer can be coated with a high Z material, in particular on the inner surface. In addition, it can be coated with a secondary radiation layer further inside than the barrier layer made from high Z material. The subsequent secondary radiation layer can also be provided separately from the coated cover layer and can comprise its own reinforcing layer. Several such secondary radiation layers can follow either separately or integrally formed. In such a layer sequence, one or more individual composite layer(s) can be provided, but it is not obligatory. A cover layer, optionally coated, can be provided on the opposite surface.

Preferably, the individual composite layer comprises a reinforcing layer. The reinforcing layer can be provided between the barrier layer and the secondary radiation layer. Alternatively, it can also be provided on one side of the barrier layer and secondary radiation layer. The reinforcing layer should be relatively tear-resistant in its layer plane and not stretch easily in order to avoid that, upon corresponding tensile stress, the relatively thin secondary radiation layer and particularly the even thinner barrier layer expand locally and become even thinner or, in an extreme case, even rupture. A film material can be used as a reinforcing layer, The reinforcing layer can comprise a thin, tear-resistant fabric. The reinforcing layer can comprise an aramide or a glass fiber material. Alternatively, other fibrous materials such as for example plastic, carbon or ceramic fibers or metal filaments, e.g. copper or tungsten filaments, can be used, Fabrics can be produced from all these fibers or filaments, A material which is especially suitable for absorbing X-rays, such as for example copper or in particular tungsten material, offers the additional advantage that it increases the absorption effect while at the same time providing stiffness. The metal filaments and especially fabrics made from metal filaments have the advantage that they provide particularly high stability but also the advantage that they possess a certain inherent stability which is especially important for applications where the radiation protection material has to be brought into a certain shape and should remain in that shape during use, for instance gonad protection, etc.

Another extremely important field of application for such formable radiation protection materials is the use as overhand protection. Such overhand protection is used when very difficult operations have to be performed which are impeded by the use of radiation protection gloves. In such cases, what is referred to as an overhand protection is used which is attached for example to the arm of the surgeon or to the patient, and which the surgeon is able to manipulate during the operation such that his unprotected hands underneath are sufficiently protected.

It is also possible to introduce the above-mentioned fibrous materials or filaments into the matrix of the barrier layer and/or the matrix of the secondary radiation layer and to embed them therein.

The reinforcing layer can also be provided on the outside surface of an individual composite layer, or a reinforcing layer can be provided on each outside surface of an individual composite layer. It is also possible to form the reinforcing layer as the slide-promoting layer at the same time.

The low Z material of the secondary radiation layer is preferably selected such that it exhibits as even and as high an absorption as possible throughout the desired energy range of 60 to 125 kV, in particular together with the barrier layer, whereby the selection can be made independently of the generation of secondary radiation. In particular in the case of radiation protection material which is only intended for use in specific applications having a somewhat limited energy range, the selection can also be optimized with respect to that limited energy range.

Optimally, the high Z material of the secondary radiation layer is selected such that it provides maximum absorption, if possible, for the typical secondary radiation of the secondary radiation layer whose energy is essentially composed of the X-ray emission spectra of the elements of the secondary radiation layer. Both in the selection of the material of the secondary radiation layer and the selection of the material of the barrier layer, the weight per unit area of the material at which the desired absorption coefficient is reached is taken into consideration as well, in addition to the absorption properties. At the same time, aspects like producibility, miscibility with the matrix material, etc. can also be taken into account.

The boundary between low Z material and high Z material approximately lies with elements with an atomic number Z of 60, wherein the low Z material has an atomic number of about 39 to 60 and the high Z material has an atomic number higher than 60 and preferably higher than 70. Even if the two ranges overlap for the atomic number 60, the high Z material is always different from the low Z material in order to do justice to the different absorption requirements.

The individual elements of the low Z material or the high Z material, respectively, can be provided in the radiation protection material in the form of a thin film. However, they are typically dispersed in powder form in a matrix material. Examples of matrix materials include rubber, latex, synthetic, flexible or solid polymers or silicone materials.

The low Z material can comprise at least one of the following elements: tin, antimony, iodine, caesium, barium, lanthanum, cerium, praseodymium and neodymium. One or more of these elements can additionally be mixed with elements not from this group; elements suitable for use in such a mixture include for example rare-earth elements with Z=60 to 70, preferably samarium, gadolinium, terbium and/or erbium and/or ytterbium.

The high Z material of the barrier layer can comprise at least one of the following materials: tantalum, tungsten, bismuth.

In a preferred embodiment, the barrier layer comprises bismuth, and the secondary radiation layer comprises tin as well as at least one of the elements lanthanum, cerium or gadolinium.

Preferably, the radiation protection material with 0.25 mm nominal Pb value consists of two individual composite layers, while the radiation protection material with 0.35 mm nominal Pb value consists of three individual composite layers. The individual layers can be provided directly next to each other, e.g. in contact with each other or connected. It is also possible to separate the individual layers for example by means of an air gap, a fabric or another intermediate layer. This applies in general and independently of the nominal Pb value.

The radiation protection material comprising three individual composite layers has an asymmetric structure with two barrier layers on the outside and one on the inside. Consequently, it has a surface which is closer to the inside barrier layer than the second surface. In the case of a sequence of barrier layers, the next inside barrier layer also contributes to the absorption of secondary radiation from the secondary radiation layers deeper inside. The surface closest to the inside barrier layer can be used as the layer closest to the body of the user in radiation protection clothing. It can therefore be planned to mark three-layer radiation protection material and radiation protection material in order to guarantee correct incorporation into the radiation protection clothing. The same generally applies to radiation protection material with an uneven number of layers and radiation protection material with an even number of layers but an asymmetrical structure. The marking can e.g. be a color mark or writing.

The present invention furthermore relates to radiation protection clothing comprising a radiation protection material according to the present invention and in particular radiation protection clothing wherein in the case of an asymmetrical structure of the radiation protection material the surface with most barrier layers in its vicinity is provided closest to the body to be protected.

In the following, the invention and embodiments of the invention are described in detail on the basis of illustrated examples.

Figure 1:
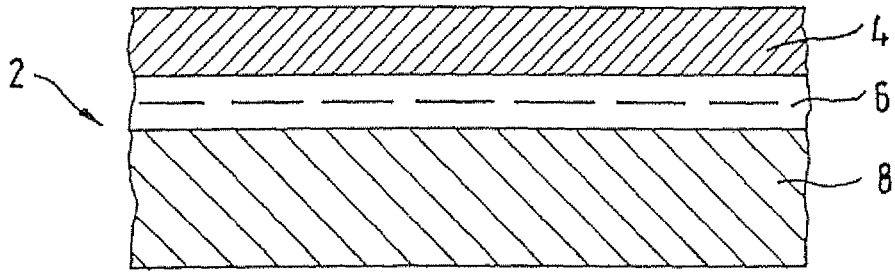
FIG. 1 shows an individual composite layer for a radiation protection material according to the present invention.

FIG. 1 shows the structure of an individual composite layer 2 comprising a barrier layer 4, a reinforcing layer 6 and a secondary radiation layer 8. In particular, the barrier layer comprises a layer of 0.5 kg/m$^2$ bismuth including the appropriate elastomer matrix, and the secondary radiation layer comprises a layer of 0.9 kg/m$^2$ of a tin/gadolinium filling including an elastomer matrix. The weight per unit area of tin is 0.7 kg/m$^2$ , and the weight per unit area of gadolinium is 0.2 kg/m$^2$, which results in the total weight per unit area of the secondary radiation layer of about 0.9 kg/m$^2$. The pure matrix weight accounts for 10 to 20%, preferably 12 to 15% of the total weight per unit area.

The thickness of an individual composite layer with about 0.125 mm nominal Pb value is between about 0.3 to 0.6 mm, more precisely about 0.40 mm. With 4 individual composite layers with a thickness of 0.40 mm each, a protective apron with a nominal Pb value of 0.50 mm can be created which offers the same attenuation as a corresponding lead apron. The lead-free apron with 0.5 mm nominal Pb value thus weighs 5.6 kg/m$^2$. The corresponding lead apron has a pure lead weight of 5.7 kg/m$^2$. To this are added the weight of the oxygen in the case of lead oxide, and the weight of the matrix. Lead aprons with 0.5 mm nominal Pb value therefore usually weigh 7 kg/m$^2$. Thus, the lead-free apron weighs 20% less than a lead apron.

Between the two layers of the individual composite layer 2, the reinforcing layer is provided which according to the embodiment is manufactured from a very thin tear-resistant fabric, e.g. glass fibers or aramide. Thus, the weight per unit area of a glass filament fabric is about 25 g/m$^2$ and is therefore negligible as far as increasing the weight of the apron is concerned. The entire individual composite layer 2 can therefore be designed to be relatively thin and very light. It has a weight per unit area of about 1.4 kg/m$^2$.

The three layers of an individual composite layer 2 are connected during the manufacturing process. For example, in a first step, the secondary radiation layer 8 can be applied onto the reinforcing layer 6, and in a second step, the barrier layer 4 can be applied on the other side of the reinforcing layer 6. The individual composite layer itself exhibits a relatively high degree of flexibility. The selection of the matrix material essentially determines the flexibility of the individual barrier layer. The material of the reinforcing layer as well influences the flexibility/stiffness of an individual composite layer. For instance, glass fiber material is especially suitable due to its high degree of flexibility. In addition, it is chemically safe. A conceivable alternative to glass fibers would be an aramide material. It has a slightly higher stiffness, which can be disadvantageous especially for the use as radiation protection clothing. In order to manufacture rigid construction elements such as plates and supports, carbon fibers can be used in the reinforcing layer. The carbon fibers can be additionally or exclusively embedded in the matrix material.

Figure 2:
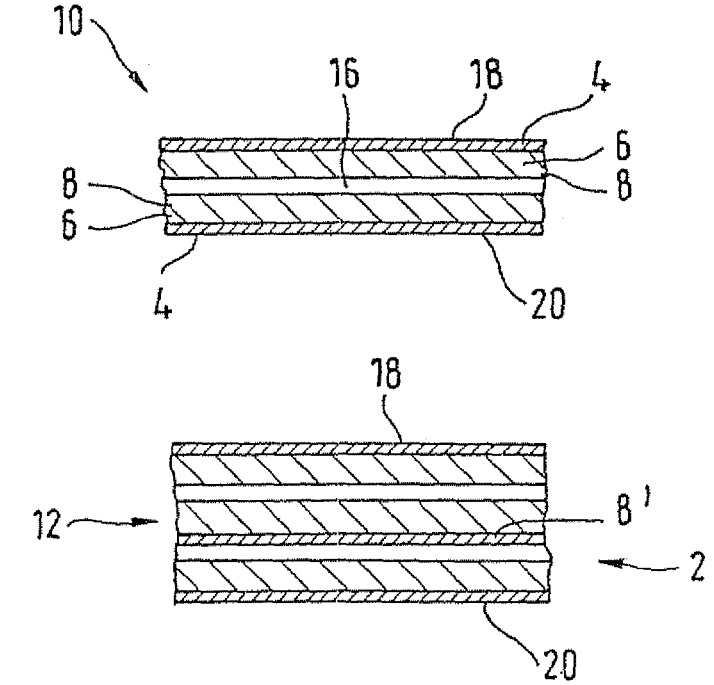
FIG. 2 shows various radiation protection materials according to the present invention.

FIG. 2 shows different radiation protection materials 10, 12 and 14. The topmost radiation protection material 10 comprises two individual composite layers. Similar to FIG. 1, the layer structure of the two layer sequences comprises the barrier layer 4, reinforcing layer 6 and secondary radiation layer 8. The radiation protection material 10 comprising two individual composite layers 2 has a symmetrical structure. The gap 16 shown between the two secondary radiation layers 8 indicates that the two individual composite layers do not necessarily have to be connected via their surface. It can also be inferred from FIG. 1 that each of the two surfaces 18, 20 of the dual-layer radiation protection material 10 is formed by a barrier layer 4.

A three-layer radiation protection material is shown with the reference number 12. Essentially, the statements made with respect to the dual-layer radiation protection material 10 apply here as well. It can be inferred that compared to the dual-layer radiation protection material 10 a third individual composite layer has been added from below, so that a second barrier layer 8', provided inside of the radiation protection material 12, is closer to the lower surface 20 than to the upper surface 18. In this asymmetrical structure it is preferred that the lower surface 20 be provided closer to the skin.

A four-layer radiation protection material 14 is shown as well. Compared to the three-layer radiation protection material 12, another individual composite layer 2 has been added on top of the three-layer layer sequence.

Thus, it is possible in practice to manufacture radiation protection material with different protection values at a relatively low expense by using a single individual composite layer 2 as a starting material for radiation protection material with different protection values, In particular, dual-layer radiation protection material 10 with a nominal value of 0.25 mm Pb, three-layer radiation protection material 12 with a nominal value of 35 mm Pb and four-layer radiation protection material 14 with a nominal value of 0.50 mm Pb (according to DIN IN 61331-3) can be produced by multiple layering.

Such radiation protection material is suitable for the applications mentioned above. In particular, it can be used to produce radiation protection clothing, especially aprons, gloves, thyroid gland protection, gonad protection, ovary protection, etc., but also eye protection, protective shields, etc. Flexible protective curtains low in secondary radiation can also be produced as stationary protection devices for X-ray machines. Such protective curtains can be used with stationary machines or on movable or mobile frames.

Figure 3:
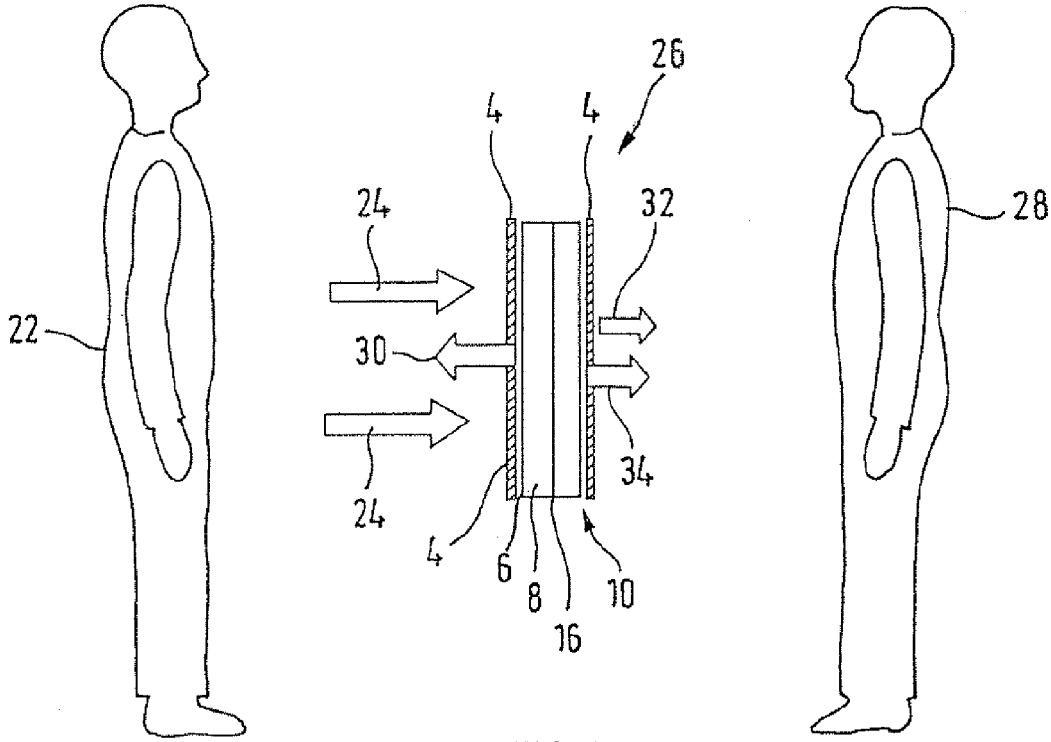
FIG. 3 shows an explanation of the mechanism of the radiation protection material according to the present invention.

FIG. 3 shows a schematic view of the individual X-ray portion and the effect of radiation protection clothing comprising the radiation protection material 10 according to the present invention. Such a situation arises if the medical professional is in close proximity to the patient, which is for example common in minimally invasive surgeries as well as in catheter examinations in angiography. The radiation 24 primarily emitting from the X-rayed patient 22 hits the radiation protection clothing 26, typically the radiation protection apron of the medial professional 28, and excites fluorescence or secondary radiation, part of which, see arrow 30, is scattered back towards the patient. On the side of the medical professional 28, number 32 indicates the primary radiation portion and number 34 denotes the secondary radiation from the side of the medial professional. It can also be inferred from the schematic dimensions (which are not true to scale) that the primary radiation, but also the secondary radiation, is not completely absorbed by the radiation protection material but it is merely reduced significantly.

Equating the fluorescence radiation and the secondary radiation of the secondary radiation layer 8, as was done above, is not completely correct in terms of physics. Rather, the secondary radiation 30, 34 from the secondary radiation layer 8 comprises different portions, for example the classic scattering radiation, Compton scattering and fluorescence radiation. However, fluorescence radiation accounts for most of this secondary radiation. For the tin used in the secondary radiation layer 8, the energy of the fluorescence radiation (K radiation) is 26 keV. This low-energy X-ray radiation mainly affects the skin and organs close to the skin. In this connection, female mammary gland tissue becomes the focus of attention, which is relatively radiosensitive, as are male testicles and the thyroid gland. According to recent scientific findings, this low-energy radiation is much more effective biologically than higher energy X-rays. The high Z radiation protection material of barrier layer 4 on the other hand only develops relatively little fluorescence radiation or secondary radiation since its K absorption edge falls within a high energy range, typically at 70 to 90 keV and consequently no or only little excitement takes place in the usual application range of 60 to 125 kV tube voltage of the X-ray source. Thus, the two outside barrier layers 4 create an effective shield against the secondary radiation also towards the body of the patient 22.

Figure 4:
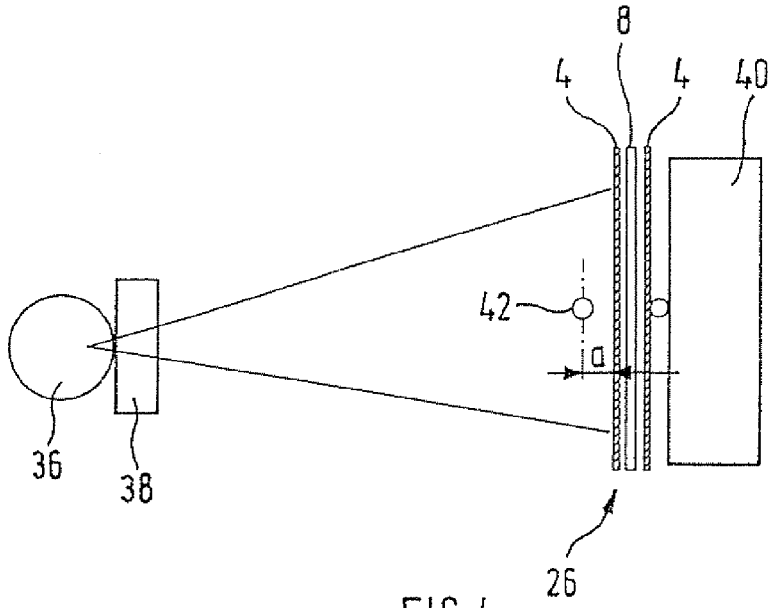
FIG. 4 shows a schematic view of an experimental set-up for determining the efficiency of the radiation protection material according to the present invention.

The effect described above could be confirmed by measurements as shown in the schematic illustration of FIG. 4. In particular, FIG. 4 shows the X-ray tube with the reference number 36 and the shield 38. From there, the X-ray extends in the direction of the body of the medical professional represented by a water phantom 40. Reference number 42 denotes a measuring chamber which is positioned at a distance a from the radiation protection clothing 26. Number 4 again represents the barrier layers facing the patient and the medical professional, respectively, wherein the secondary radiation layer is marked 8. The water phantom 40 with a water content of 25×25×15 $cm^3$ mimics the scattering properties of the medical professional's body. The secondary radiation layer of the radiation protection clothing 26 was formed from lead-free material, in particular tin with a weight per unit area of 2.0 $kg/m^2$. The dosage was measured with an air kerma measuring chamber 42, at distances of 0 (bodily contact), 5, 10, 20 and 30 cm from the radiation protection clothing 26, with a barrier layer of 0.7 $kg/m^2$ bismuth, once on the side of the patient and once on the side of the medical professional. The difference between these two measured values corresponds to the increase in dosage due to the secondary radiation generated in the material (e.g. tin K radiation). The patient would be exposed to this additional radiation if the surface of his body were located at the measuring chamber 42.

The measuring results show that the portion of secondary radiation at the location of the patient can be reduced to one third if the barrier layer is located at the side of the patient. The reduction in secondary radiation at the patient is most significant when the medical professional 40 stands directly by the patient.

In a second round, a measuring location between the radiation protection clothing 26 and the water phantom 40 (which corresponds to the body of the medical professional) was selected since the medical professional wears the apron directly on the surface of his body. The barrier layer of 0.7 kg $m^2$ bismuth is again provided once on the side of the patient and once on the side of the medical professional. The difference between the two measured values corresponds to the relative decrease in dosage due to the secondary radiation. Accordingly, by providing a barrier layer on the side of the medical professional—just as on the side of the patient—the secondary radiation can be reduced to one third. The provision of a double-sided barrier layer as in the radiation protection material 10, 12, 14 according to the present invention combines these two attenuation effects and leads to a marked reduction in the secondary radiation both on the side of the medical professional and the side of the patient.

The results of the measurements are summarized in Tables 1 and 2 below:

TABLE 1

Portion of secondary radiation on the patient's body surface tube voltage 70 kV

| Distance medical professional/patient | Without barrier layer on patient | With barrier layer on patient | Fluorescence portion shielded by barrier layer |
|---|---|---|---|
| 0 cm (bodily contact) | 33.6% | 10.6% | 23% |
| 10 cm | 12.1% | 4.7% | 7.4% |
| 20 cm | 5.4% | 2.2% | 3.2% |
| 30 cm | 1.5% | 0.4% | 1.1% |

TABLE 2

| Tube voltage | Portion of secondary radiation on the medical professional's body surface: Without barrier layer on medical professional | With barrier layer on medical professional | Fluorescence portion shielded by barrier layer |
|---|---|---|---|
| 70 kV | 241% | 77% | 164% |
| 100 kV | 155% | 74% | 81% |
| 125 kV | 139% | 81% | 58% |

In general, and in particular in the example above, the radiation protection clothing 26 usually contains the radiation protection material in the form of a powder. If only the elements are mentioned in connection with the embodiment, this particularly refers to the powder form or compounds of the element or elements in powder form.

Figure 5:
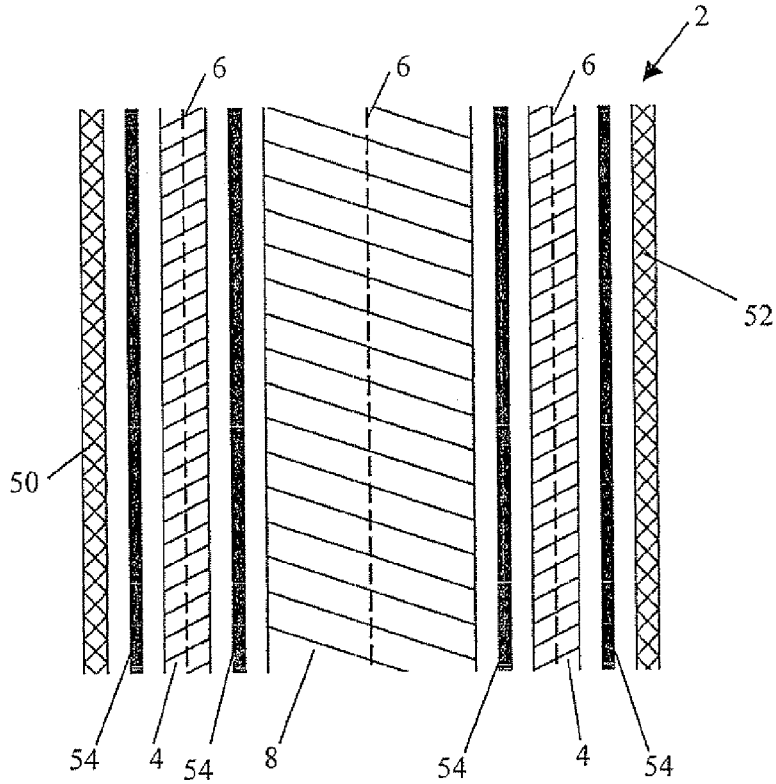
FIGS. 5, 6 and 7 show a cross-section of three embodiments of radiation protection materials with sliding layers.
Figure 6:
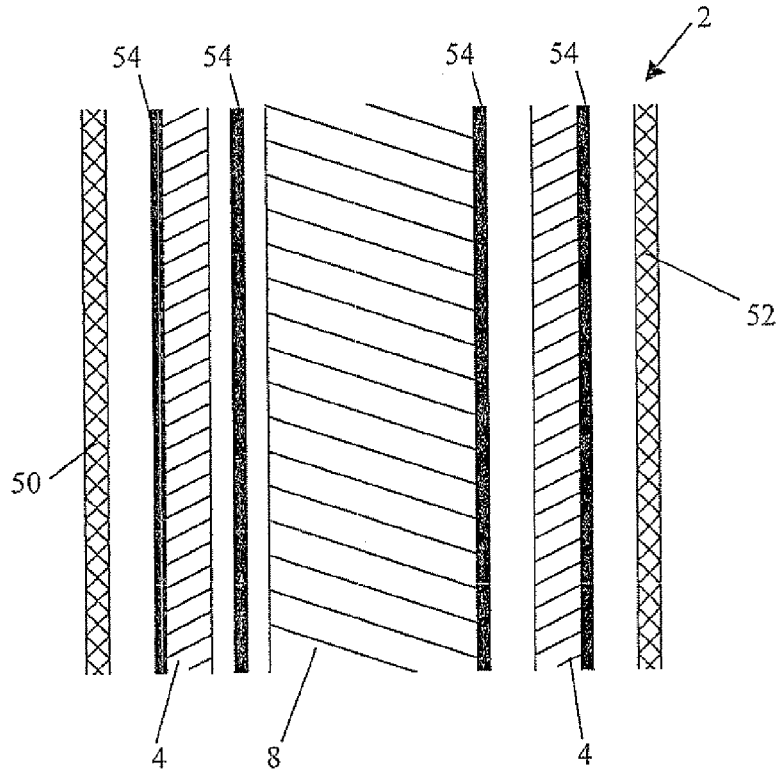
Figure 7:
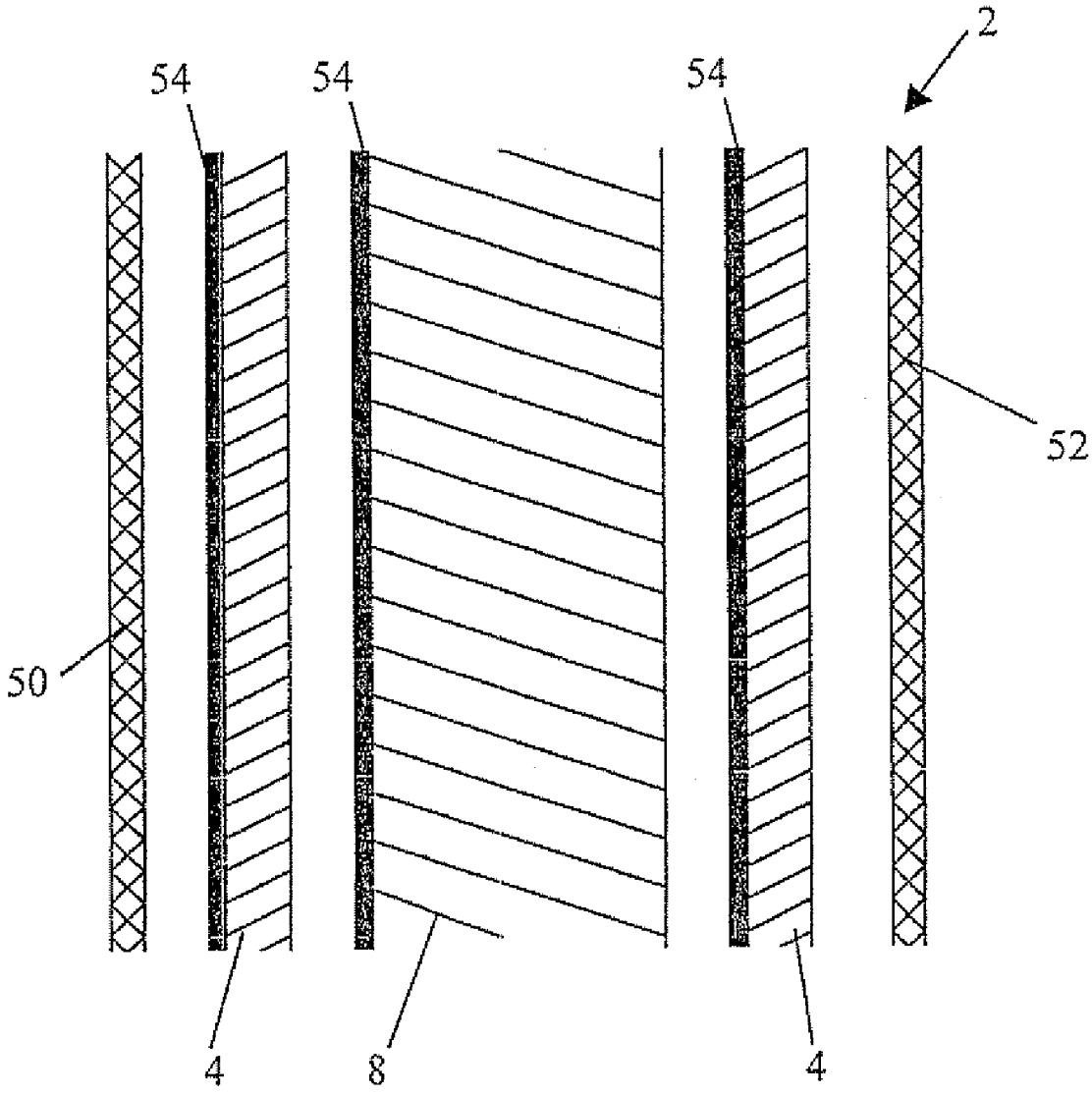

Radiation protection material with a sliding layer or several sliding layers is explained in more detail based on the examples according to FIGS. 5, 6 and 7.

The radiation protection material 2 depicted in FIG. 5 comprises three radiation protection components or individual radiation protection layers, namely a barrier layer 4 on the left side of FIG. 5 facing the patient, a secondary radiation layer 8 in the middle, and a barrier layer 4 on the right side of FIG. 5 closer to the medical professional. Each of the layers 4 and 8 comprises a reinforcing layer 6 which can be provided somewhere in the middle area of the layer, or also in the surface area of the layer.

Furthermore, FIG. 5 shows a cover layer 50 on the left and a cover layer 52 on the right, The cover layer 50 on the left is preferably formed from a strong plastic fiber fabric with a coating on its left surface, preferably a polyurethane coating, in order to protect the fabric from splattered liquid. The cover layer 52 on the right is preferably also provided with a strong plastic fiber fabric wherein in this case a coating, preferably of polyurethane, can be provided either on the left side of cover layer 52 or on the right side of cover layer 52 as depicted in FIG. 5.

Between the left cover layer 50 and the left barrier layer 4, there is a sliding layer 54, as is the case between the left barrier layer 4 and the secondary radiation layer 8, between the secondary radiation layer 8 and the right barrier layer 4, and between the right barrier layer 4 and the right cover layer 52. The thicknesses of the individual layers and the distances between the layers, where the sliding layers 54 are positioned, are depicted at an exaggerated scale for the purpose of clarity. In reality, these distances are small in relation to the layer thicknesses so that the various sliding layers 54 are more or less completely in physical contact with their two neighboring layers.

The sliding layers 54 are only sewn or glued together with the other radiation protection material in the area of their top edge, Additional bonding along the two side edges, i.e. behind the drawing plane and in front of the drawing plane and/or in the area of the lower edge is optionally possible. It is also possible to laminate each sliding layer 54 onto one of the two neighboring layers.

It is emphasized that the reinforcing layers 6 are optional and do not have to necessarily be present. It is furthermore emphasized that there are embodiments of the radiation protection material 2 wherein the left barrier layer 4 is not present. Moreover, it is emphasized that alternatively the left barrier layer 4 and the secondary radiation layer 8 can be combined to form an individual composite layer, preferably in a structure as described in the present application. A structure comprising several such individual composite layers as described in the present application can be used as well. As another alternative, two secondary radiation layers 8 can be provided instead of the single secondary radiation layer 8 depicted in the drawing.

Not all four sliding layers 54 have to be present. In particular between the right barrier layer 4 and the right cover layer 52, a sliding layer 54 is non-essential if the right cover layer 52 is coated on its left side.

FIG. 6 illustrates that—optionally in some or all of the situations of adjacent components—the sliding layer 54, if a sliding layer 54 is even provided, can be realized in the form of a layer which is connected to a component of the radiation protection material 2 via a large surface area or the entire surface area. Compared to the embodiment according to FIG. 5, the left barrier layer 4 is now provided with a sliding layer 54 on its left side, the secondary radiation layer 8 is provided with a sliding layer 54 on its right side, and the right barrier layer 4 is provided with a sliding layer on its right side. There is a "free" sliding layer 54 between the left barrier layer 4 and the secondary radiation layer 87 as in the example according to FIG. 5.

In this case, the sliding layers 54 connected with the radiation protection components via a large surface area or the entire surface area are preferably formed from a light, pliant fabric, preferably polyamide fabric or polyester fabric. Such fabrics are available with a weight per unit area of about 30 $g/m^2$ and above. During the production of the layers 4 and 8, a viscous material, e.g. a mixture of matrix material (in particular polyurethane or rubber) and a low Z material or a high Z material, respectively, was applied onto the fabric and then reached a ready-for-use state due to a chemical reaction in the matrix material.

The example according to FIG. 7 differs from the example according to FIG. 6 in that the secondary radiation layer 8 and the right barrier layer each have their directly assigned sliding layer 54 on the left side in FIG. 7 (instead of on the right side), and that the "free" sliding layer 54 of FIG. 6 is not present.

As regards the exaggerated distances, the number of sliding layers, the number of radiation protection components and other possible embodiments, the statements made in connection with the example according to FIG. 5 analogously also apply to the embodiment according to FIG. 6.

The invention claimed is:

1. Laminated lead-free radiation shielding device comprising at least two individual composite layers, each individual composite layer comprising a secondary radiation layer with a material comprising chemical elements with a low atomic number and a barrier layer with a material comprising chemical elements with a high atomic number, wherein the individual composite layers are arranged in the radiation shielding device in such a way that a barrier layer is arranged on both surfaces of the radiation shielding device and the respective secondary radiation layer is arranged at a distance from the surfaces.

2. Radiation shielding device according to claim 1, wherein one individual composite layer has a protection value of 0.25 mm Pb nominal value or less.

3. Radiation shielding device according to claim 2, wherein one individual composite layer has a protection value of 0.125 mm Pb nominal value and the individual composite layers are identical.

4. Radiation shielding device according to claim 2, wherein the individual composite layers have an identical protection value.

5. Radiation shielding device according to claim 1, wherein one individual composite layer comprises a reinforcing layer.

6. Radiation shielding device according to claim 5, wherein the reinforcing layer is arranged between the barrier layer and the secondary radiation layer.

7. Radiation shielding device according to claim 5, wherein the reinforcing layer is provided on the outside of the individual composite layer.

8. Radiation shielding device according to claim 7, wherein the reinforcing layer is a covering layer for radiation protection clothing.

9. Radiation shielding device according to claim 8, wherein the reinforcing layer comprises an aramide fabric or a glass-fiber fabric.

10. Radiation shielding device according to claim 5, wherein the reinforcing layer comprises a thin, tear-resistance fabric.

11. Radiation shielding device according to claim 5, wherein the reinforcing layer comprises carbon fibers.

12. Radiation shielding device according to claim 5, furthermore comprising a sliding layer between the individual layers of the radiation shielding device.

13. Radiation shielding device according to claim 1, wherein the material comprising chemical elements with a low atomic number of the secondary radiation layer comprises elements with an atomic number Z of 39 to 60.

14. Radiation shielding device according to claim 13, wherein the material comprising chemical elements with a low atomic number comprises at least one of the following elements: tin, antimony, iodine, caesium, barium, lanthanum, cerium, praseodymium and neodymium.

15. Radiation shielding device according to claim 13, wherein the material comprising chemical elements with a low atomic number additionally comprises at least one of the elements with an atomic number between Z>60 and Z=70.

16. Radiation shielding device according to claim 13, wherein the material comprising chemical elements with a low atomic number is a mixture of tin and at least one of the elements lanthanum, cerium or gadolinium.

17. Radiation shielding device according to claim 13, wherein the material comprising chemical elements with a low atomic number is a mixture of antimony and at least one of the elements lanthanum, cerium or gadolinium.

18. Radiation shielding device according to claim 1, wherein the material comprising chemical elements with a high atomic number of the barrier layer is a material with a high absorption coefficient with respect to the secondary radiation emitting from the secondary radiation layer.

19. Radiation shielding device according to claim 1, wherein the material comprising chemical elements with a high atomic number of the barrier layer comprises elements with an atomic number Z higher than 60 with the exception of lead.

20. Radiation shielding device according to claim 19, wherein the material comprising chemical elements with a high atomic number comprises elements with an atomic number Z higher than 70.

21. Radiation shielding device according to claim 20, wherein the material comprising chemical elements with a high atomic number additionally comprises at least one element with an atomic number between Z>60 and 70.

22. Radiation shielding device according to claim 19, wherein the material comprising chemical elements with a high atomic number comprises tantalum and/or bismuth and/or tungsten.

23. Radiation shielding device according to claim 1, wherein the radiation shielding device with 0.25 mm Pb nominal value comprises two individual composite layers.

24. Radiation shielding device according to claim 1, wherein the radiation shielding device with 0.35 mm Pb nominal value comprises three individual composite layer.

25. Radiation shielding device according to claim 1, wherein the radiation shielding device with 0.50 mm Pb nominal value comprises four individual composite layers wherein each barrier layer is arranged outside facing the next surface of the radiation shielding device.

26. Radiation shielding device according to claim 1, wherein the radiation shielding device with 0.50 mm Pb nominal value comprises five individual composite layers wherein each barrier layer is arranged outside facing the next surface of the radiation shielding device.

27. Radiation shielding device according to claim 1, furthermore comprising an outer covering layer.

28. Radiation shielding device according to claim 27, wherein the outer covering layer comprises textile material and/or PVC.

29. Radiation shielding device according to claim 27, wherein the covering layer is integrally coated with a barrier layer.

30. Radiation protection clothing or radiation protection device comprising a radiation shielding device according to claim 1.

31. Radiation protection clothing or radiation protection device according to claim 30, wherein in case of an asymmetrical structure of the radiation shielding device the surface with more barrier layers in its vicinity is arranged closer to the body to be protected.

* * * * *